United States Patent [19]

Schramm

[11] 4,328,709

[45] May 11, 1982

[54] ELECTRONIC AUDIO VISUAL TORQUE INDICATOR ADAPTER

[76] Inventor: Wayne E. Schramm, 8427 Frost Way, Annandale, Va. 22003

[21] Appl. No.: 141,358

[22] Filed: Apr. 18, 1980

[51] Int. Cl.[3] ..... B25B 23/142

[52] U.S. Cl. ..... 73/862.23; 81/479; 200/56 R; 340/688

[58] Field of Search ..... 73/139, 862.23; 200/56 R; 340/688; 81/479

[56] References Cited

U.S. PATENT DOCUMENTS

| | | | |
|---|---|---|---|
| 625,843 | 5/1899 | Jones . | |
| 843,929 | 2/1907 | Charland . | |
| 1,136,407 | 4/1915 | Carrigan | 200/56 R |
| 1,742,229 | 1/1930 | Wood . | |
| 2,003,910 | 6/1935 | Stephenson | 200/56 R X |
| 2,523,352 | 9/1950 | Behr . | |
| 2,792,734 | 5/1957 | Larson et al. . | |
| 3,142,177 | 7/1964 | Hanscom et al. . | |
| 3,664,186 | 5/1972 | Kraus . | |
| 3,967,513 | 7/1976 | Myrdal . | |
| 4,112,749 | 9/1978 | Smyth . | |

*Primary Examiner*—Charles A. Ruehl

*Attorney, Agent, or Firm*—Kerkam, Stowell, Kondracki & Clarke

[57] ABSTRACT

A device is used for indicating a preset torque on a conventional torque wrench. The device has a front part and a back part, which are held together by a U-shaped bracket. The bracket serves to secure the front part and back part of the device on opposite sides of the torque wrench's dial. The device includes a battery which is electrically connected to a copper plate on the back part of the device. This copper plate electrically connects to the pointer of the torque wrench by way of the indicating plate and rod. When the pointer is deflected an amount determined by the positioning of the device on the indicating plate, the pointer will contact and electrically connect to a resilient terminal on the device. This contact will connect the battery to a circuit in the device, causing the device to generate an audible and turn on a light. A test switch is included and used for bypassing the pointer arm in determining that the circuit is still operative. An additional terminal is used for indicating that the preset amount of torque has been exceeded. This overtorque terminal is electrically connected to the pointer only when the pointer has been deflected past the preset amount. When this happens, the circuit will generate an audible signal distinctively different from the audible signal which occurs without the overtorque terminal being electrically connected to the pointer.

8 Claims, 6 Drawing Figures

ELECTRONIC AUDIO VISUAL TORQUE INDICATOR ADAPTER

BACKGROUND OF THE INVENTION

1. Field of the Invention

This invention relates to signaling devices useful with an instrument or tool having a pointer and indicating plate. More particularly, this invention relates to a signaling device for indicating that a predetermined torque has been applied to a conventional torque wrench.

2. Description of the Prior Art

In the measuring arts, there are numerous tools and instruments which use a pointer and an indicator plate. Commonly, the pointer will rotate or otherwise move along the indicator plate, thereby pointing to indicia representing values of the measured variable. Among these instruments, are such devices as a gas gauge, a weight scale, and a torque wrench.

One of the disadvantages of such pointer in indicating plate instruments is that they are sometimes used in places where it is very hard, if not impossible, to see where the pointer arm is pointing to on the indicator plate. At other times, one can see generally where the pointer is pointing to but, because of the angle one is viewing the indicator plate at, parallax error is introduced. This problem of not being able to view the indicator plate directly is especially troublesome when using a torque wrench, where one often has to work at unusual angles or in unusual positions.

It is therefore useful to have a device which indicates when a pointer has been deflected a certain amount, thus avoiding the necessity of having a direct view of the indicating plate.

The following U.S. Patents include various devices for overcoming the necessity of direct viewing of an indicator plate:

Jones U.S. Pat. No. 625,843
Charland U.S. Pat. No. 843,929
Wood U.S. Pat. No. 1,742,229
Behr U.S. Pat. No. 2,523,352
Larson et al. U.S. Pat. No. 2,792,734
Hanscom et al. U.S. Pat. No. 3,142,177
Kraus U.S. Pat. No. 3,664,186
Myrdal U.S. Pat. No. 3,967,513
Smyth U.S. Pat. No. 4,112,749

The Kraus and Larson et al patents show specifically designed torque wrenches, wherein the mechanic need not have a direct view of the indicating plate for correctly using them. However, these devices are of little use to a mechanic who does not wish to purchase a completely new torque wrench. The Behr patent similarly shows a pointer activated indicating device which requires that one replace one's present gas gauge. That is, like Larson and Kraus, the use of the Behr device requires one to replace one's presently owned pointer and indicating plate tool or instrument. These devices are thus incapable of use with one's present pointer and indicating plate instrument.

The Smyth and Myrdal patents show pointer activated indicating devices for torque wrenches wherein the device must be slid up and down the length of the torque beam. This is disadvantageous in that it is hard to position the sliding unit in a position corresponding to the predetermined amount of torque desired, unless one uses a workpiece to apply that degree of torque. Alternately, Smyth discusses adding calibrations along the length of the wrench in order to enable the user to set the device.

The Charland and Wood patents both show sliding units which have two contacts. The sliding unit is positioned along the indicating plate at a point corresponding to a predetermined value. When the pointer reaches the place where the sliding unit is positioned, the pointer will connect the two contacts together, thus closing a circuit at least partially removed from the sliding unit. The necessity for having wires extending from the sliding unit makes it more difficult to adapt a conventional pointer and indicating plate instrument.

The Jones patent discloses a pointer triggered alarm device wherein a sliding unit, such as clip 10 of FIG. 1, has one contact. An alternate clip device, such as 12 of FIG. 1, is used for making the pointer a part of the circuit. When the pointer touches clip 10 it closes a circuit, thus ringing a bell 14. In addition to the disadvantage of requiring wires extending off the clips, Jones necessitates the use of at least two clips, one to carry current to the pointer arm, and the other to provide a completed circuit path when the pointer reaches a predetermined value.

The Hanscom patent shows a torque sensing device which slides along a bridge 8 of FIG. 1. In addition to requiring modification of a conventional torque wrench to include a bridge, Hanscom is disadvantageous in that it uses the pointer to trigger a spring device which must then be reset before the next use.

It will then be seen that although the prior art has included many attempts to provide a pointer triggered indicating device, the inventions which have been developed are all subject to one or more disadvantages. Specifically, these devices have required extensive modification of the conventional pointer and indicating plate instrument, necessitated cumbersome wiring removed from a dial plate fastening part, required the operator to reset after each use, or have been difficult and inconvenient to set to the appropriate value.

SUMMARY OF THE INVENTION

It is an object of the invention to provide a signaling device which may be used with a conventional pointer and indicating plate instrumentor tool, and more particularly with a conventional torque wrench.

It is another object of the invention to provide a torque indicating device which is easily calibrated without the necessity of actually applying torque to a workpiece.

It is still another object of the invention to provide a torque indicating device which does not require resetting after each use.

It is still further object of the invention to provide a pointer triggered indicating device which does not require combersome wiring.

A further object of the invention is to provide a torque indicating device which has both a signal indicating a preset value of torque and a distinctly different signal indicating that the torque has exceeded the preset value.

Other objects of the invention will become apparent during the course of the specification and claims.

BRIEF DESCRIPTION OF THE DRAWINGS

Additional objects and advantages of the invention will become apparent to those skilled in the art as the description proceeds wth reference to the accompanying drawings wherein.

DETAILED DESCRIPTION OF THE INVENTION

Figure 1:
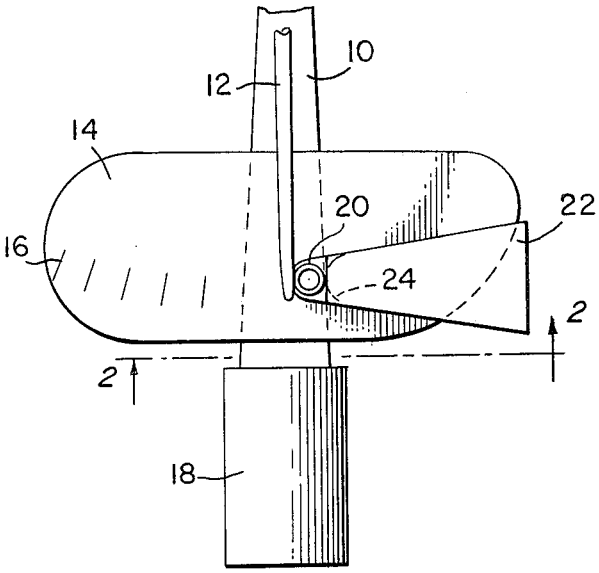
FIG. 1 shows a simplified front view of the present invention mounted on a conventional torque wrench.

The pointer triggered indicating device of the present invention is shown in simplified form mounted on a conventional torque wrench in FIG. 1. That portion of the torque wrench shown in FIG. 1 includes torque beam 10, pointer 12, handle 18, and indicating plate 14 having indicia 16 thereupon. The present invention includes a front part 22 which is secured on the indicating side of the indicating plate 14. For simplicity's sake, FIG. 1 simply shows the outline of the present invention in order to demonstrate how it clamps on to an indicating plate. Front part 22 may be moved along the width of indicating plate 14 so that spring 20 may be positioned over the indicia 16, corresponding to a preset amount of torque which the operator desires to apply.

Figure 2:
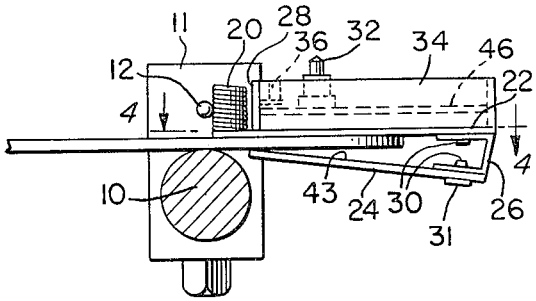
FIG. 2 shows a side view along the lines 2—2 of FIG. 1.

Turning next to FIG. 2, a side view of the present invention, with the torque beam in cross section is shown as would appear along lines 2—2 of FIG. 1. In this view, the casing 34, which encloses the electrical circuit devices of the present invention, is included. In addition to showing a cross section view of torsion beam 10 and side view of indicating plate 14 and pointer arm 12, this drawing includes the torsion head 11 of the torque wrench. As shown, the preferred embodiment of the present invention includes a body having a front part 22 and a back part 24 which are attached together by a resilient U-shaped bracket 26. The back part 24 is short enough to avoid bumping the torque beam 10 until the edge of spring 20 is over the center of torque beam 10 as appears in FIG. 2. The bracket 26, which is preferably made of a thin piece of conductive metal, is fastened to the front part and back part by means of the bolts 30. The head 31 of the bolt attaching the clamp to the back part is shown, while the head of the bolt which connects the clamp to the front part is not shown for simplicity's same. Alternately, the clamp could be welded, glued, or otherwise fastened to the front part and back part. The front part 22 and back part 24 may be made of a conventional circuit board material having copper plating on one side thereof. The underside of front part 22 may have a layer of two-sided tape or other sticky material to minimize sliding between the front part 22 and indicator plate 14. Back part 24 has its copper plated side 43 disposed towards the front of the indicator plate 14 and thus touching the back of indicator plate 14.

Mounted on the front part 22 is coil spring 20 for use as an electrical terminal in contacting pointer 12. Overtorque terminal 28 is preferably a copper plate or piece attached to the side of casing 34, such that pointer 12 will first touch spring terminal 20 and when the torque is further increased, the pointer 12 will push spring terminal 20 into overtorque terminal 28. Casing 34 generally encloses the electrical components of the present invention, which are mounted therein on a component shelf 46. The component shelf 46 is raised above the copper plating (not shown in this drawing), which is on the front side of front part 22. Test switch 32 is mounted within or above casing 34.

Figure 3:
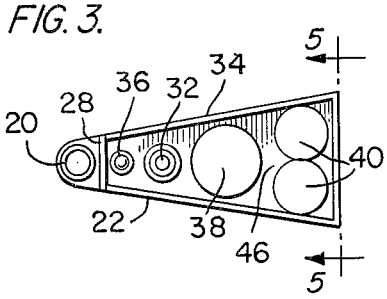
FIG. 3 shows a front view of the present invention including several of the electronic parts.
Figure 4:
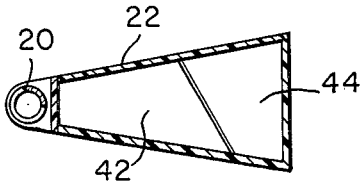
FIG. 4 shows a simplified front view along lines 4—4 of FIG. 2 of the present invention with the electronic parts removed.

FIG. 3 shows a top view of front part 22 and several of the larger components mounted on the component shelf 46 which rests just above front part 22. Batteries 40, speaker 38, pushbutton switch 32, and light bulb 36 may all be mounted upon component shelf 46. Alternately, casing 34 may include a cover piece over the top which would then enclose batteries 40 and have loudspeaker 38 mounted on its underside with pushbutton switch 32 and light bulb 36 mounted on its topside. Additionally mounted on component shelf 46 will be several resistors, capacitors and transistors which are not shown in this drawing. A front view of front part 22 is shown in FIG. 4 as would appear along lines 4—4 of FIG. 2. The copper plating on the front side of front piece 22 has been etched or otherwise removed on part of that surface so as to leave copper plating at component copper terminal 42 and wrench copper terminal 44. As shown, spring terminal 20 is not in electrical contact with either component copper terminal 42 or wrench copper terminal 44.

Figure 5:
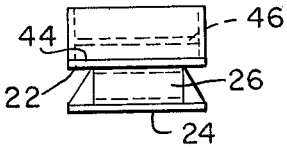
FIG. 5 is an end view of the present invention taken along lines 5—5 of FIG. 3.

FIG. 5, which is an end view of the present invention, generally along lines 5—5 of FIG. 3 includes bracket 26 and back part 24. It should be appreciated that bracket 26 not only attaches front part 22 and 24, but actually urges them together in order to clamp onto the indicating plate 14 as is best shown in FIG. 2. As is shown in FIG. 5, component shelf 46 is disposed above and somewhat removed from the front side of front part 22. In this way, the components mounted on component shelf 46 may be electrically connected to component copper terminal 42 by a short piece of wire (this is not shown) and will not be in electrical contact with wrench copper terminal 44.

Figure 6:
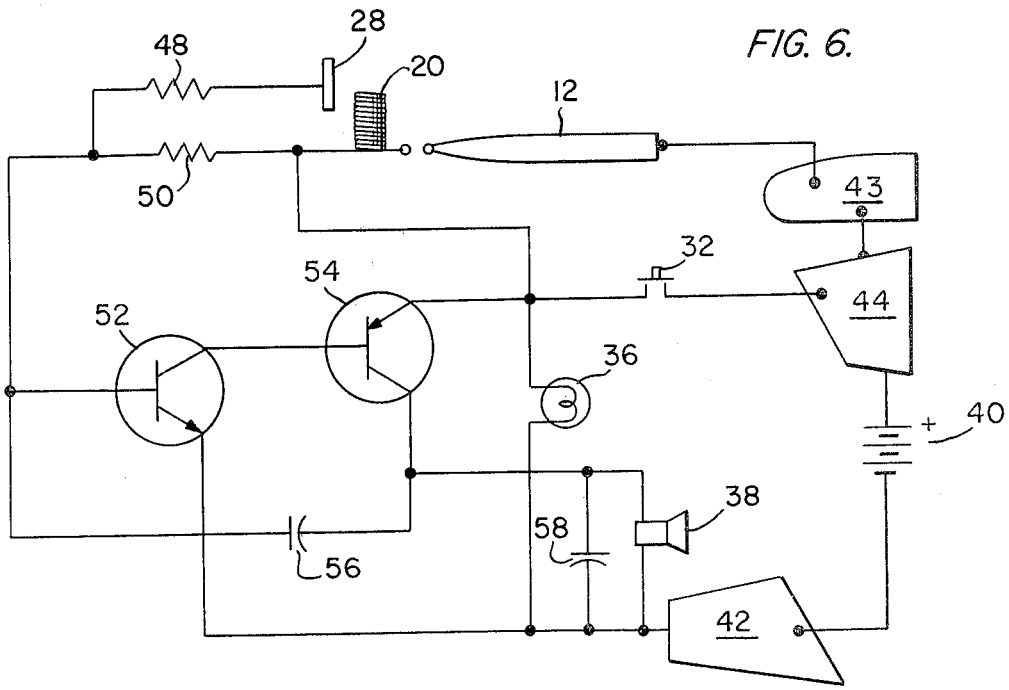
FIG. 6 is a circuit diagram of the present invention with mechanical parts shown schematically.

FIG. 6 is a circuit diagram of the present invention with mechanical parts shown schematically. Transistors 52 and 54 are cross coupled by way of capacitor 56 and resistor 50, so as to form an oscillator circuit. As will be apparent to those familiar with this conventional oscillator circuit, the frequency of oscillation will depend on the value of resistor 50 as well as the circuit capacitance values. The output of the oscillator is derived from the collector of transistor 54 and is fed to speaker 38, connected in parallel with output capacitor 58. Connected from the emitter of transistor 54 to component copper terminal 42 is a light source 36, shown as a light bulb. This light source could, of course, be an LED or other light source. Pushbutton 32 operates as a test switch for determining that the battery and circuitry is properly functioning. Battery 40, which may be one watch battery or alternately two watch batteries connected either in series or parallel, is connected to the component copper terminal 42 of front part 22. Transistor 52, light bulb 36, capacitor 58 and speaker 38 are also connected to component copper terminal 42 as by a short piece or pieces of wire running from terminal 42 up to component shelf 46.

The positive terminal of the battery is connected to the wrench copper terminal 44 which, like component copper terminal 42, is on the front side of front part 22. Wrench copper terminal 44 is in electrical contact with back part copper plate 43 by way of the conductive U-bracket 26. Referring momentarily back to FIG. 2, it will be apparent that back part copper plate 43 electrically contacts the back of indicator plate 14 when the present device is slid onto the indicator plate. Since the back of indicator plate 14 is in electrical contact with pointer 12 by way of the torque beam 10 and torsion head 11, mounting of the present device on the indicator plate 14 will then establish a circuit between the positive terminal of battery 40 and pointer 12 as shown generally in FIG. 6. In order to start the oscillations of transistors 52 and 54 and turn on light 36, a positive voltage must be applied at the emitter of transistor 54. This will be done when pointer arm 12 touches and therefore electrically connects to, spring terminal 20. An alternate circuit path for positive current may be established by the test push button switch 32 which will allow the user to determine whether the battery and electronic circuitry are functioning correctly. As shown, either the pushing of test switch 32 or the contacting of pointer 12 with spring terminal 20 will turn on light 36 and start transistors 52 and 54 oscillating at a frequency which will be heard over speaker 38.

If the torque is increased beyond where pointer 12 contacts with spring terminal 20, spring terminal 20 will be brought into contact with overtorque terminal 28. When this happens, overtorque resistor 48 will then be placed in parallel with resistor 50 thereby changing the frequency of oscillation output to speaker 38. It is preferable if the values of resistors 48 and 50 are such that their resistance in parallel is significantly different than the resistance of resistor 50 alone, thus ensuring a distinctive change in tone in the oscillations heard from speaker 38. For example, overtorque resistor 48 could have the same value as resistor 50, in which case the parallel resistance would be one-half of the resistance of resistor 50 alone.

Several modifications of the oscillator circuit will be readily apparent to those of skill in the art. Instead of using capacitor 58, an alternate embodiment uses a resistor is series with capacitor 56. One could use the overtorque terminal 28 and spring terminal 20 for switching in different capacitive values. Instead of using the cross-coupled transistors 52 and 54, one could use a standard 555 integrated circuit hooked up as an astable multivibrator.

Although the preferred embodiment of the present invention has been shown as using visual and auditory outputs, any sensory output (meaning an output capable of being directly sensed by a human being) could as well be used. Similarly, numerous modifications in the components used for securing the device to the indicator plate will be apparent to those of skill in the art. Since numerous adaptations and modifications in the present invention will be apparent, it is to be appreciated that the preferred embodiment as disclosed herein is for illustrative purposes only. The scope of the present invention therefore should include all devices which fall within the scope of the appended claims.

What is claimed is:

1. A device for indicating the deflection of a pointer on a tool or instrument having a pointer and indicating plate, comprising:

a body, means for securing said body to said indicating plate, a battery mounted to said body, a first terminal attached to said body and electrically connected to a first pole of said battery, said first terminal being positioned on said body so as to electrically connect to said pointer when the body is secured to the indicating plate, a second terminal attached to said body and positioned to contact and electrically connect to said pointer when the pointer is deflected a preset amount, and a circuit mounted to said body, said circuit being electrically connected to a second pole of said battery and said second terminal, and said circuit outputs a first sensory signal when contact between the pointer and said second terminal electrically connects the circuit to said first pole of the battery.

2. The device of claim 1 wherein said first terminal is positioned on said body so as to electrically connect to said pointer by way of said indicating plate.

3. The device of claim 2 wherein the first terminal and second terminal are positioned such that the device will indicate the deflection of a pointer on a conventional torque wrench.

4. The device of claim 2 or 3 wherein the body has at least a front part and a back part, and said means for securing resiliently clamps the indicating plate in between said front part and said back part.

5. The device of claim 1 or 3, further comprising:

a normally open test switch, which upon closure electrically connects the circuit to the first pole of the battery causing the circuit to output a sensory signal.

6. The device of claim 1 or 3 further comprising:

a third terminal attached to said body and positioned to electrically connect to said pointer when the pointer is deflected beyond the preset amount, said third terminal being electrically connected to said circuit at a different point in said circuit than a point of said circuit which is electrically connected to said second terminal, and the circuit outputs a second sensory signal when contact between the pointer and said third terminal connects the circuit to said first pole of the battery, the second sensory signal being distinctively different from the first sensory signal.

7. The device of claim 2, wherein the second terminal is resilient.

8. The device of claim 2 wherein the body has a front part and a back part, and said means for securing holds the indicating plate in between said front part and said back part.

* * * * *